US008443560B2

(12) United States Patent
Uhl et al.

(10) Patent No.: US 8,443,560 B2
(45) Date of Patent: May 21, 2013

(54) CONCRETE FORM BLOCK AND FORM BLOCK STRUCTURE

(75) Inventors: Hans-Peter Uhl, Mississauga (CA); Wilhelm Knecht, Mississauga (CA)

(73) Assignee: 2158484 Ontario Inc, Ontario (CA)

( * ) Notice: Subject to any disclaimer, the term of this patent is extended or adjusted under 35 U.S.C. 154(b) by 0 days.

(21) Appl. No.: 13/125,459

(22) PCT Filed: Oct. 23, 2009

(86) PCT No.: PCT/CA2009/001531
§ 371 (c)(1),
(2), (4) Date: Apr. 21, 2011

(87) PCT Pub. No.: WO2010/045740
PCT Pub. Date: Apr. 29, 2010

(65) Prior Publication Data

US 2011/0203202 A1 Aug. 25, 2011

Related U.S. Application Data

(60) Provisional application No. 61/108,484, filed on Oct. 24, 2008.

(51) Int. Cl.
*E04C 2/52* (2006.01)
*E04C 3/30* (2006.01)
*E04B 1/02* (2006.01)

(52) U.S. Cl.
USPC ..... 52/220.1; 52/568; 52/569; 52/570

(58) Field of Classification Search
USPC ..... 52/220.1, 415, 418, 419, 426, 309.11, 52/309.12, 561, 565, 568, 569, 570, 572
See application file for complete search history.

(56) References Cited

U.S. PATENT DOCUMENTS

| | | | | |
|---|---|---|---|---|
| 2,315,194 | A * | 3/1943 | Foreman | 52/565 |
| 3,204,381 | A * | 9/1965 | Perreton | 52/309.12 |
| 3,676,967 | A * | 7/1972 | Frati | 52/220.2 |
| 3,691,714 | A | 9/1972 | Stepp | |
| 3,835,608 | A | 9/1974 | Johnson | |

(Continued)

FOREIGN PATENT DOCUMENTS

| | | | |
|---|---|---|---|
| CA | 2270083 | A1 | 7/2000 |
| CA | 2298319 | A1 | 8/2001 |

(Continued)

*Primary Examiner* — Mark Wendell
(74) *Attorney, Agent, or Firm* — Defillo & Associates, Inc; Evelyn A. Defillo

(57) ABSTRACT

A concrete form block for construction of a building includes first and second panel devices, each having inner and outer faces separated by ribs. Projecting connectors are disposed on the inner faces and each has a pin-receiving aperture. U-shaped couplers are used to connect the two panel devices together so that their inner faces are parallel. Each connector has first and second connecting pins and these are received in the apertures of the connectors of the panel devices, with each pin being pivotable in its aperture after insertion. The panel devices can be moved from a collapsed configuration having at least a reduced space between the inner faces and an in-use configuration with more space between these faces. There is also disclosed a panel structure having upper and lower channel forming frames connected to an outer wall portion thereof. These form a channel for receiving equipment for utilities.

16 Claims, 14 Drawing Sheets

U.S. PATENT DOCUMENTS

| | | | | |
|---|---|---|---|---|
| 4,889,310 | A * | 12/1989 | Boeshart | 249/41 |
| 5,375,810 | A | 12/1994 | Mathis | |
| 5,490,362 | A | 2/1996 | Mercier | |
| 5,570,552 | A * | 11/1996 | Nehring | 52/426 |
| 5,707,184 | A | 1/1998 | Anderson et al. | |
| 5,788,423 | A | 8/1998 | Perkins | |
| 5,820,304 | A | 10/1998 | Sorheim et al. | |
| 5,881,511 | A * | 3/1999 | Keller, Jr. | 52/220.2 |
| 6,062,722 | A | 5/2000 | Lake | |
| 6,240,692 | B1 * | 6/2001 | Yost et al. | 52/426 |
| 6,318,040 | B1 * | 11/2001 | Moore, Jr. | 52/426 |
| 6,321,496 | B1 | 11/2001 | Martin, Jr. | |
| 6,336,301 | B1 | 1/2002 | Moore, Jr. | |
| 6,401,413 | B1 | 6/2002 | Niemann | |
| 6,401,419 | B1 | 6/2002 | Beliveau | |
| 6,438,918 | B2 * | 8/2002 | Moore et al. | 52/426 |
| D464,145 | S | 10/2002 | Scherer et al. | |
| 6,464,199 | B1 | 10/2002 | Johnson | |
| 6,481,178 | B2 * | 11/2002 | Moore, Jr. | 52/741.13 |
| 6,519,906 | B2 | 2/2003 | Yost et al. | |
| 6,526,713 | B2 * | 3/2003 | Moore, Jr. | 52/309.11 |
| 6,609,340 | B2 * | 8/2003 | Moore et al. | 52/309.11 |
| 6,681,539 | B2 | 1/2004 | Yost et al. | |
| 6,742,758 | B2 | 6/2004 | Janesky | |
| 6,758,636 | B2 | 7/2004 | Rainey et al. | |
| 6,792,729 | B2 | 9/2004 | Beliveau | |
| 6,915,613 | B2 | 7/2005 | Wostal et al. | |
| 7,165,374 | B2 | 1/2007 | Ohanesian | |
| 7,347,029 | B2 * | 3/2008 | Wostal et al. | 52/426 |
| 7,410,328 | B2 | 8/2008 | Hamel | |
| 7,415,805 | B2 * | 8/2008 | Nickerson | 52/426 |
| 7,568,676 | B2 | 8/2009 | Takagi et al. | |
| 7,584,540 | B2 | 9/2009 | Latham | |
| 7,739,846 | B2 * | 6/2010 | Garrett | 52/426 |
| 7,827,752 | B2 * | 11/2010 | Scherrer | 52/426 |
| 8,037,652 | B2 * | 10/2011 | Marshall et al. | 52/309.11 |
| 2003/0005659 | A1 * | 1/2003 | Moore, Jr. | 52/473 |
| 2004/0200168 | A1 | 10/2004 | Takagi et al. | |
| 2006/0185291 | A1 * | 8/2006 | Mathe | 52/426 |
| 2007/0294970 | A1 * | 12/2007 | Marshall et al. | 52/309.11 |
| 2008/0022619 | A1 | 1/2008 | Scherrer | |
| 2008/0127600 | A1 | 6/2008 | Schiffmann et al. | |
| 2008/0202054 | A1 | 8/2008 | Abella | |
| 2008/0236083 | A1 | 10/2008 | Banova | |
| 2008/0245013 | A1 | 10/2008 | Carlisle | |
| 2008/0307736 | A1 * | 12/2008 | Trimmer | 52/426 |
| 2009/0120027 | A1 | 5/2009 | Amend | |

FOREIGN PATENT DOCUMENTS

| | | | |
|---|---|---|---|
| CA | 2409970 | A1 | 12/2001 |
| CA | 2578796 | A1 | 12/2006 |
| CA | 2591664 | A1 | 12/2007 |
| DE | 2255810 | A1 | 5/1974 |
| DE | 22555810 | | 5/1974 |

* cited by examiner

CONCRETE FORM BLOCK AND FORM BLOCK STRUCTURE

FIELD OF THE INVENTION

The present invention relates to concrete form block modules for use in a concrete forming system for construction of a building structure and further relates to concrete form panels and panel structures.

BACKGROUND OF THE INVENTION

Concrete blocks have been used for many years as the main structural component for walls in buildings, especially larger buildings such a commercial buildings, and the like. In order to form a wall or similar structure from concrete blocks, the concrete blocks are set in place in horizontal rows, one horizontal row on top of the other in vertically overlapping relation in order to maximize structural integrity. Various shapes of walls can be made. Typically, buildings are composed of straight walls adjoined at corners. The concrete blocks are merely oriented at a right angle (90 degrees) at the corner, while still vertically overlapping one another.

Concrete blocks are rough in appearance since the exterior surface of concrete blocks is merely the rough concrete itself. In order to have a building exterior that is attractive, it is necessary to have a separate exterior covering mounted onto the concrete structure, which is costly and time consuming. Such exterior coverings are typically metal siding, which is inexpensive and can be readily coloured, but is only reasonably attractive. Alternatively, other types of structural blocks, such as ones having a natural stone appearance, can be added to the exterior of the concrete block structure, or at least an exposed portion thereof.

Further, concrete block walls are time consuming to construct, and more expensive than necessary. Also, if the interior of a concrete block wall becomes damp, various types of mold or the like can form, which is highly undesirable. An even more serious problem is that of structural integrity. It is well known that if concrete blocks become damp internally for an extended period of time, the structural integrity of the concrete blocks can be compromised, which is very highly undesirable.

Various other types of wall structures exist that offer an improvement over conventional concrete blocks for erecting buildings, retaining walls and the like. A well-known method of forming a wall is to use insulating concrete forms (ICFs) as a supporting form used during the construction of a poured concrete wall, or similar structure. Insulating concrete forms are stay-in-place formwork for energy-efficient, cast-in-place reinforced-concrete walls. The forms are interlocking modular units that are dry-stacked (without mortar) and filled with concrete. The forms lock together and serve to create a form for the structural walls of a building. Concrete is pumped into the cavity to form the structural element of the walls. Usually, reinforcing steel (rebar) is added before concrete placement to give the resulting walls flexural strength. After the concrete is cured, or firmed up, the forms are left in place permanently to provide thermal and acoustic insulation and fire protection.

Insulating concrete forms can be made from a variety of materials, including expanded polystyrene (EPS), cement-bonded wood fiber, and cement-bonded polystyrene beads. The majority of forms are made of foam insulation, such as expanded polystyrene (EPS), and are either separate panels connected with plastic connectors or ties, or are pre-formed interlocking blocks connected with plastic or steel connectors or ties. Most forms have vertically oriented furring strips built into the forms on 6", 8" or 12" centers and these strips are used to secure interior and exterior finishes.

The disadvantage of using insulating concrete forms (ICFs) as a supporting form used during the construction of a poured concrete wall, or similar structure is that they must be braced during the process of pouring the concrete wall until the concrete wall has fully set, and that an exterior wall material, such as bricks, needs to be added after formation of the concrete wall.

U.S. Pat. No. 6,681,539 issued Jan. 27, 2004 to Louis L. Yost, et al., describes a concrete form assembly made with opposed insulation panels with a plurality of vertical studs formed on the outer face of each panel. The panels are connected by a plurality of bridges and retaining clips are disposed on the ends of each of the bridges against the studs on each panel. The concrete can be received between the panels to form a wall structure. After the concrete has been poured and allowed to set, the retainers can be removed and the form panel may be removed. In one embodiment of this system, the panel on the inside of the concrete wall is not removed so as to provide an insulated panel for thermal stability of the building. Plumbing and electrical connections can be mounted inside the insulated panel by cutting a channel in the panel to receive same.

Despite these known methods for wall construction, there is still a need for improved concrete form modules for construction of a building structure or similar wall structure, and there is also a need for improved concrete formed panels and panel structures than can remain in place after concrete has been poured using such panels or panel structures.

According to one embodiment of the present invention, a concrete form module for the construction of a building structure includes a first panel device having first inner and outer faces and a second panel device having second inner and outer faces. The first and second panel devices are disposed such that the inner faces of these devices are oriented towards one another and are substantially opposite one another. A plurality of projecting connectors are disposed on each of the first inner face and the second inner face with each connector having a pin-receiving aperture formed therein. A plurality of substantially U-shaped couplers for connecting the first panel device to the second panel device so that the inner faces are substantially parallel are provided. Each connector has two substantially parallel legs forming first and second spaced-apart connecting pins. The first connecting pins are adapted for insertion into the pin-receiving apertures in the connectors of the first panel device and the second connecting pins are adapted for insertion into the pin-receiving apertures in the connectors of the second panel device. Each connecting pin is pivotable in its respective pin-receiving aperture after insertion therein. When the panel devices are connected together with these couplers, they can be moved from a collapsed configuration with reduced space between the inner faces and an usable configuration with substantially more space between these inner faces suitable for pouring concrete between the panel devices in order to form a body of structure supporting concrete when the concrete has hardened.

In one exemplary embodiment of this module, the U-shaped couplers are each integrally formed from a thermoplastic resin of sufficient strength and rigidity that the connectors can together withstand pressure of the concrete poured between the panel devices.

According to another embodiment of the invention, a concrete form panel structure for construction of a building or similar structure includes a substantially planar inner wall portion having a first surface for facing poured concrete and forming same and an opposite second surface. The panel structure further includes a substantially planar outer wall portion spaced from the inner wall portion and having an inner surface facing the second surface and an opposite outer surface. Connecting members extend between and rigidly connect the inner and outer wall portions. An upper, elongate channel forming frame is rigidly connected to the outer surface of the outer wall portion and includes an upper support plate which extends substantially the length of the channel forming frame, extends parallel to the outer surface, and is spaced from the outer surface. A lower elongate channel forming frame is rigidly connected to the outer surface of the outer wall portion as well and is spaced from the upper channel forming frame so that an elongate channel for receiving equipment for one or more utilities is formed between the channel forming frames. The lower channel forming frame includes a lower support plate which extends substantially the length of the lower channel forming frame, extends parallel to the outer surface, and is spaced from the outer surface. In use, the concrete form panel structure remains in place after the pouring of concrete when the panel structure is used to hold and form the concrete. Thus, after the initial use for forming, the form panel structure forms part of the building or similar structure.

In an exemplary version of this form panel structure, the connecting members are vertically extending ribs and hollow spaces are formed between the inner and outer wall portions and between the ribs and are adapted to receive and hold thermal insulating material.

According to still another embodiment of the invention, a concrete form panel for the construction of a building or other walled structure includes a substantially planar outer wall portion having an interior surface and an opposite second surface which is visible after completion of the building or walled structure. The form panel also has a substantially planar inner wall portion spaced from the outer wall portion and having a first surface for facing poured concrete and forming same and an opposite second surface facing the interior surface. The inner and outer wall portions are molded of thermoplastic material of sufficient strength and rigidity to support and form poured concrete. The inner wall portion is formed with a plurality of connectors distributed over the second surface thereof and usable for joining the form panel to an adjacent form panel which is spaced apart from the concrete form panel. Connecting members extend between and rigidly connect the inner and outer wall portions. The second surface of the outer wall portion is molded to form a decorative molded pattern on the second surface. In use, this form panel remains in place after the pouring of concrete using the form panel and forms part of the completed building.

In an exemplary version of this formed panel, the connecting members are vertically extending ribs and hollow spaces are formed between the inner and outer wall portions and between the ribs and are adapted to receive and hold thermal insulating material.

Further advantages, features and characteristics will become apparent for the following detailed description of exemplary embodiments, taken in conjunction with the accompanying drawings.

Figure 1:
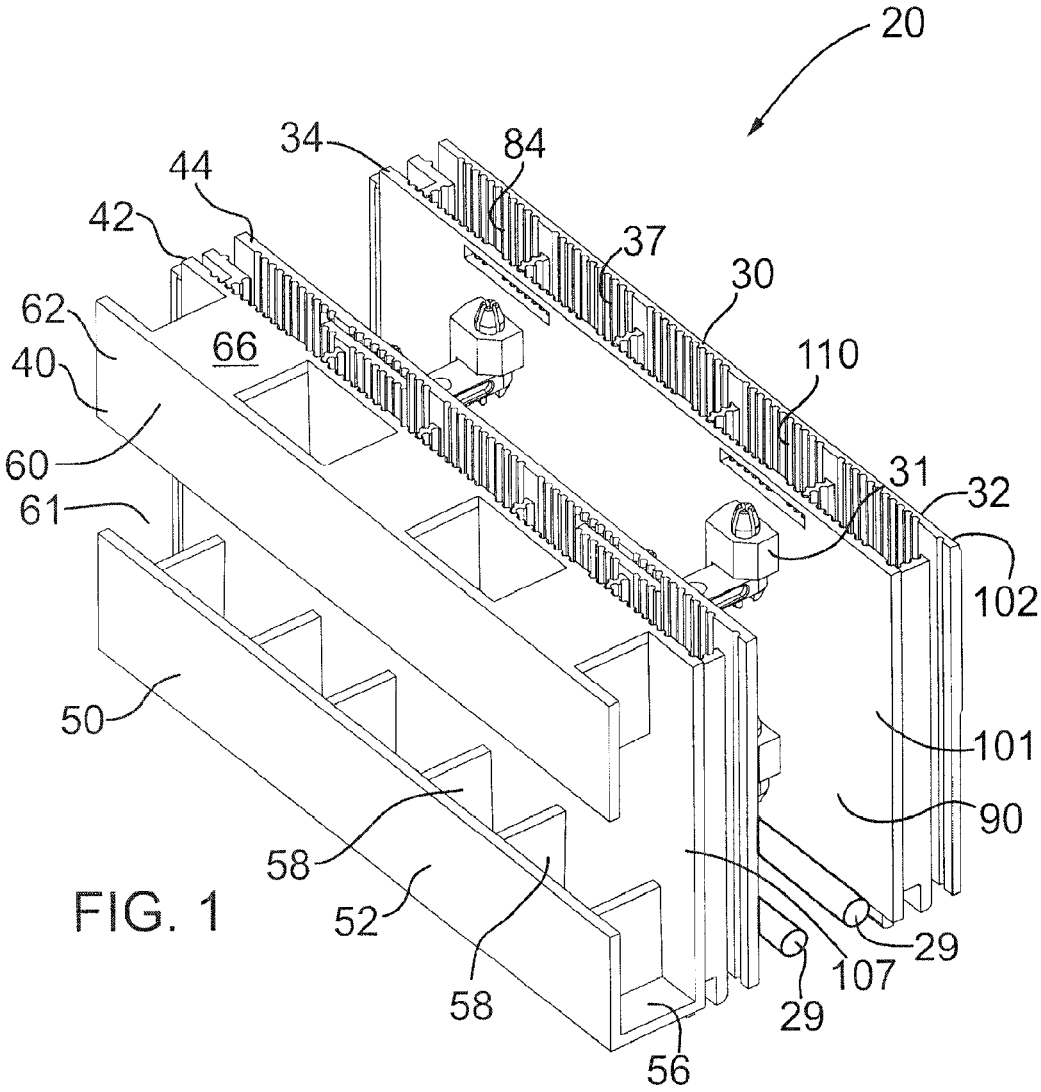
FIG. 1 is a perspective view, taken from the rear or interior side, illustrating a first embodiment of a concrete form block module in an in-use configuration with reinforcing bars mounted within the module.

Illustrated in FIGS. 1 to 5 is a concrete form block module indicated generally by reference 20, which can be used in a horizontal and vertically extending array (FIGS. 13 and 25) for construction of a building structure or similar walled structure. The module is for use in a concrete forming system which can be used in an array to form structures such as building walls and the like. The illustrated module can provide a self-standing concrete form that does not require the aid of external bracing and that is strong enough to allow concrete to be poured into the form cavity without damage to the form module or undesirable bulging. The illustrated module includes two main components comprising a first panel device 30 having first inner and outer faces 101 and 102 and a second panel device 40 having inner and outer faces 104 and 107. The first panel device is a substantially rigid external concrete forming element used to form an exterior surface of a building or other walled structure, while the second panel device is a substantially rigid internal concrete forming element that is used to form an interior surface of a structure such as a building. First and second panel devices are disposed such that the inner faces 101, 104 are oriented toward one another and are substantially opposite one another.

Figure 9:
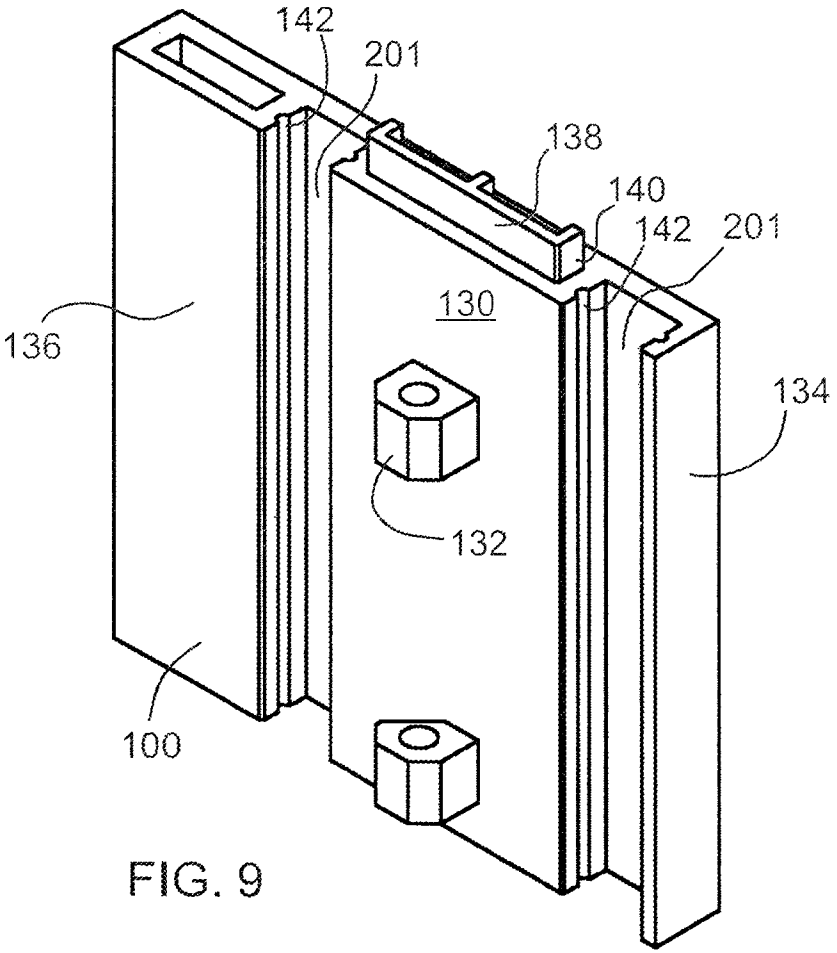
FIG. 9 is a perspective view of the end segment of FIG. 8, this view showing the inner side of the segment.

The aforementioned panel devices are connected or coupled together by means of a coupling means or coupling mechanism in order to provide the form module. In the illustrated exemplary embodiment, a plurality of projecting connectors 31 are disposed on the inner surface 101 and similar connectors 41 are provided on the inner face 104 of the panel device 40. Formed in the connectors 31 are respective pin-receiving apertures 33 and formed in the connectors 41 are similar pin-receiving apertures 43. The connectors are in the form of projections which will extend into the poured concrete and which will be embedded therein when the concrete hardens. The connectors or projections can be integrally formed on their respective panel device, for example by a molding process if the panel device is molded. As shown in FIG. 9, the first panel device 30 can, for example, be provided with four of the connectors 31 distributed evenly about its inner face with pairs being vertically aligned and it will be understood that a corresponding four connectors 41 can be provided on the inner face of the second panel device. For reasons explained hereinafter, the preferred apertures 33 and 43 are round in order to receive pins each having a round transverse cross section.

Figure 11:
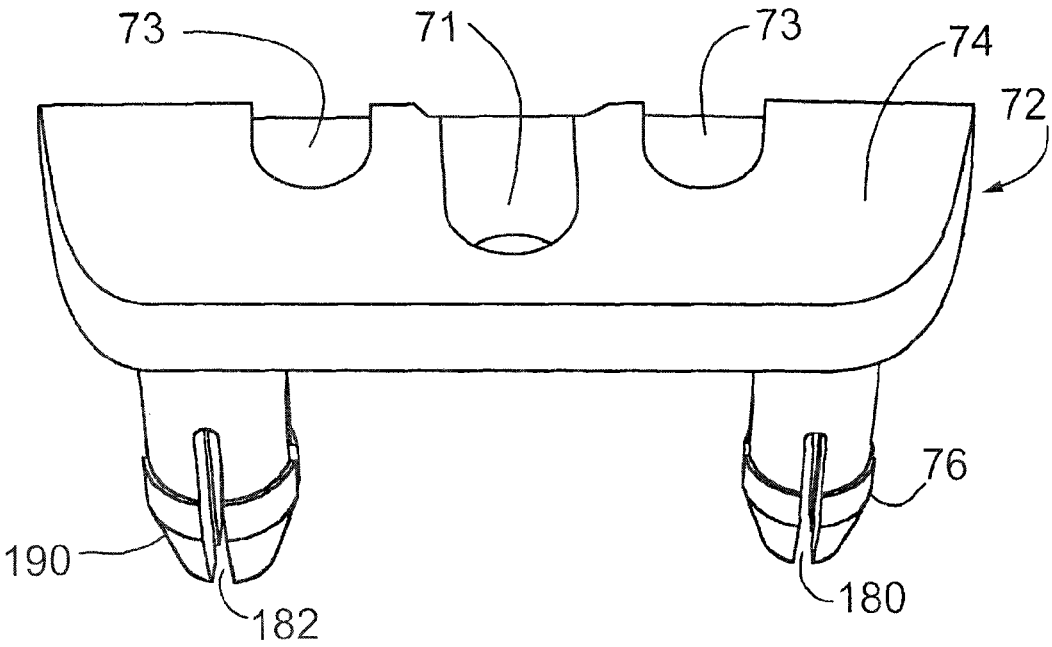
FIG. 11 is a perspective view of a plastic coupler used in the form module of FIG. 1.
Figure 12:
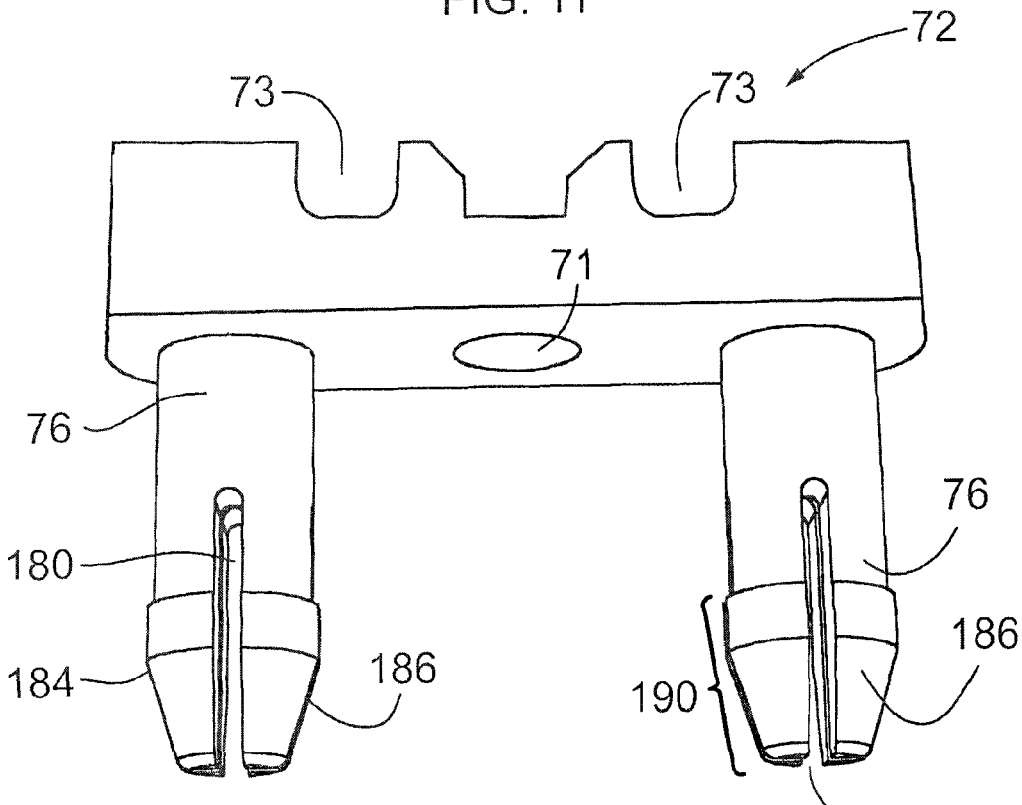
FIG. 12 is a front side view of the coupler of FIG. 11.

A plurality of couplers are used in combination with the connectors 31, 41 to join the two panel devices together. An exemplary form of coupler 72 is illustrated in FIGS. 11 and 12 and this coupler is substantially U-shaped. Using couplers of this type, the first panel device 30 can be connected to the second panel device 40 so that their inner faces are substantially parallel and thus able to form a flat, concrete structure or wall having substantially flat, parallel sides. This exemplary coupler 72 has two substantially parallel legs which extend from a main body portion 74. The legs form first and second spaced-apart connecting pins 76, with the first connecting pins being adapted for insertion into the pin receiving apertures 33 in the connectors 31 and the second connecting pins being adapted for insertion into the pin-receiving apertures 43 in the connectors 41 of the second panel device. Due to the round exterior of these pins, each pin is pivotal in its respective pin-receiving aperture after insertion therein. The illustrated exemplary couplers are each integrally formed from a thermoplastic resin of sufficient strength and rigidity that the couplers can together withstand pressure of the concrete poured between the first and second panel devices. When the first and second panel devices are connected together by these couplers 72, the panel devices can be moved from a collapsed configuration (shown in FIG. 3) with reduced space between the first and second inner faces 101, 104 and an usable configuration (shown in FIGS. 1 and 2) with substantially more space between the first and second inner faces suitable for pouring concrete between the panel devices in order to form a body of structure supporting concrete when the concrete has hardened.

Figure 2:
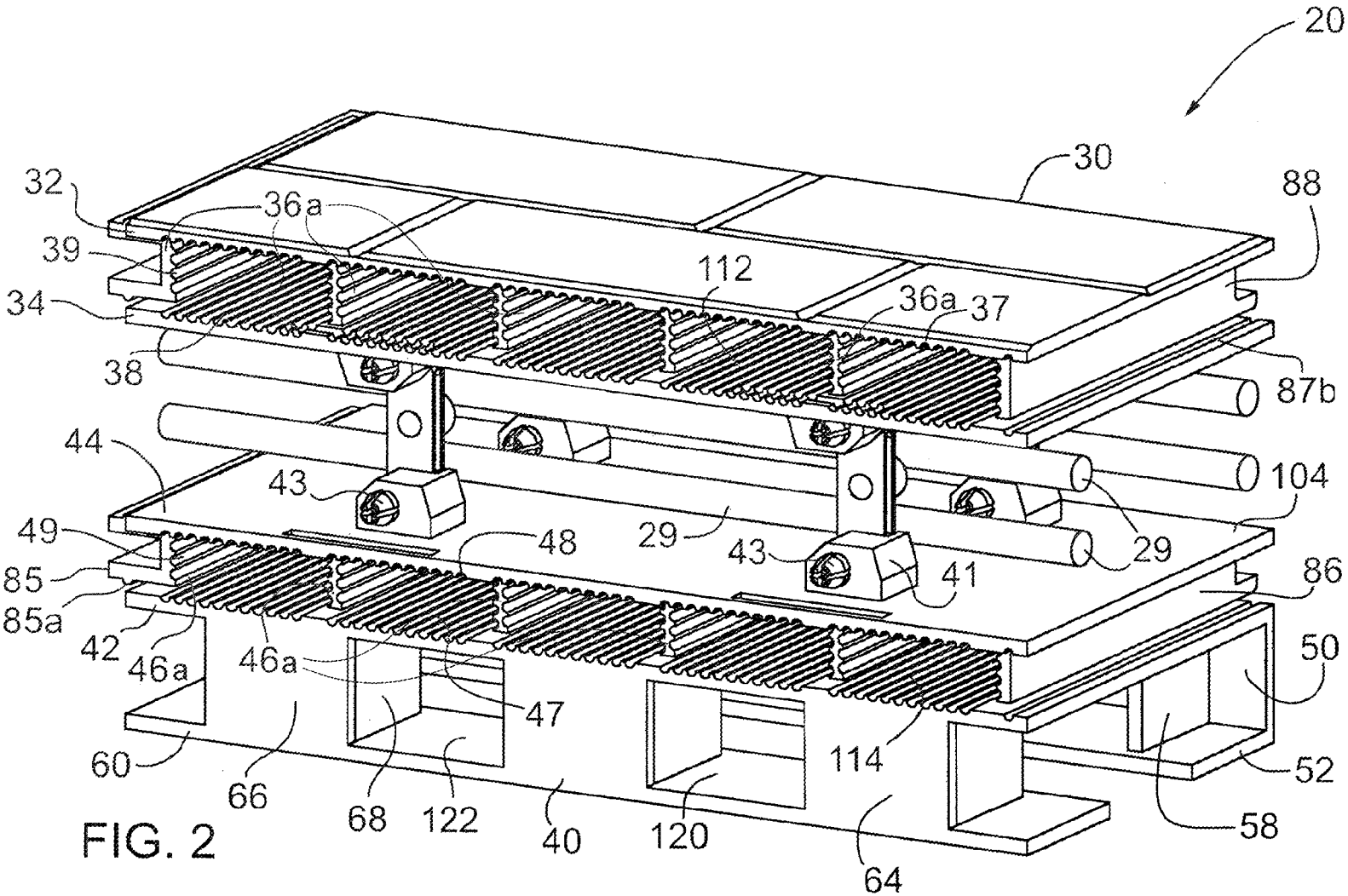
FIG. 2 is another perspective view of the embodiment of FIG. 1, this view showing the bottom end of the block module and one short side which extends vertically in use.
Figure 3:
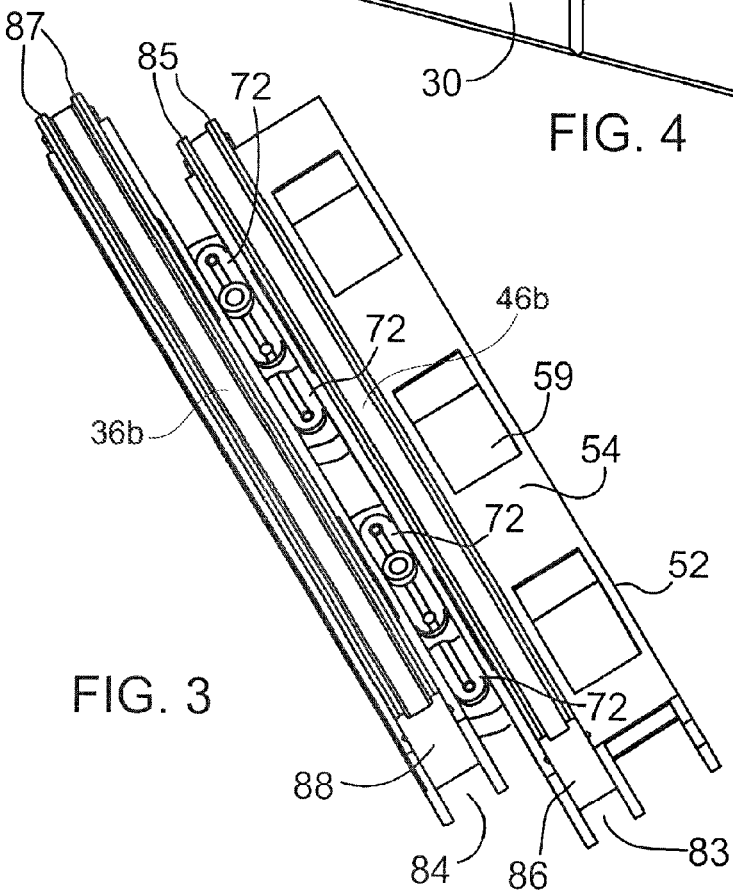
FIG. 3 is a perspective view of the embodiment of FIG. 1, this view being taken from the top of the module and showing the model in a collapsed configuration.
Figure 5:
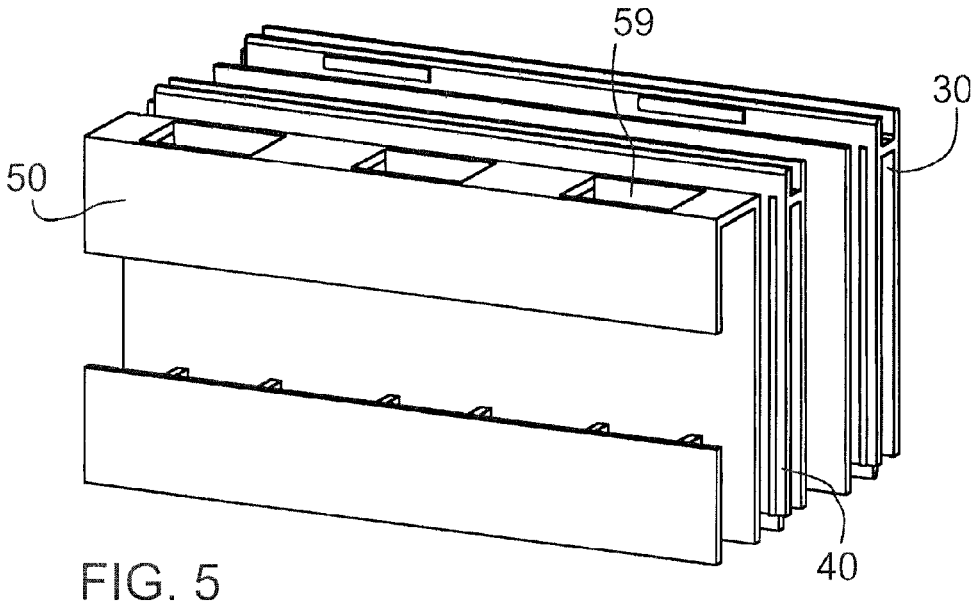
FIG. 5 is further perspective view showing the rear or interior side of the module of FIG. 3 and also showing the top side.

Turning now to the exemplary versions of the first and second panel devices that are illustrated in FIGS. 1 to 5, the external first panel device 30 comprises a substantially planar outer wall portion 32 and a substantially planar inner wall portion 34. These wall portions are connected together and spaced apart from one another by connecting members which, as illustrated, comprise rib portions 36*a* and, preferably, 36*b* (FIG. 3). An exemplary form of the panel device 36 can be molded in a single mold so as to be a single integrally formed device. The rib portions 36*a* extend parallel to each other and are evenly spaced. Preferably rib portion 36*b* extends generally horizontally. Thus, the first panel device 30 has a hollow interior of pockets extending between the outer wall portion 32 and the inner wall portion 34 and between adjacent rib portions. This hollow interior, which can comprise a series of separated spaces or pockets as shown, is adapted to receive and hold a thermal insulating material such as insulating foam, Vermiculite™, sawdust, or other known insulating material. This insulating material can be inserted into the hollow interior after the panel device 30 has been moulded. Thus the panel devices 30 and 40 are delivered fully insulated to the job site.

In an exemplary embodiment of the panel device or form panel 30, its outer face or outer surface is molded to form decorative molding on the surface. In the illustrated embodiment, the outer surface simulates a wall made of layers of bricks or blocks with grooves 106 extending between adjacent simulated bricks or block shapes 108, which can be seen in FIGS. 4 and 6. Alternatively, an exterior finish layer (not shown) can be secured to the outer surface 102 by any suitable method. For example, standard bricks or decorative stone can be laid in the usual manner over the outer face 102 to provide a pleasing appearance. Also, instead of simulated bricks or blocks, the outer surface can be molded to have the appearance of stone or wood shingles or to have a border formation.

The interior face of an outer wall portion 32 of the panel device 30 can optionally be vertically corrugated as shown in FIG. 1. These vertical corrugations 110 can strengthen the outer wall portion 32 to support poured concrete while being light in weight. Similarly the interior surface of the inner wall portion 34 is optionally vertically corrugated as indicated at 112. The wall surfaces of at least some, if not all, of the rib portions 36*a* can be vertically corrugated as indicated at 39, if desired. The corrugations on all of these surfaces provide rigidity against bending of the panel device 30.

Turning now to the construction of an exemplary second panel device 40, this panel device, which can also be formed as an integral unitary device by a single mold, comprises a substantially planar outer wall portion 42 and a substantially planar inner wall portion 44. These wall portions are connected together and spaced apart from one another by means of rigid connecting members which can take various forms. For example, they can be of different lengths, shape, size and thickness, depending on the particular requirements of the form module. In the illustrated embodiment, these connecting members are rib portions 46*a*, which can extend parallel to one another and substantially the height of the second panel device 40 and 46*b* (FIG. 3) extending horizontally. Thus, the second panel device 40 preferably has a hollow pocketed interior suitable for receiving and holding a thermal insulating material, such as the aforementioned materials that can be used within the first panel device 30. The second panel device can optionally have internal, vertical corrugations similar to those found in the first panel device 30. In particular, the outer wall portion 42 can be provided with vertical corrugations 47 on its interior surface and the inner wall portion 44 can be provided with vertical corrugations 48 on its interior surface.

Also, the rib portions 46 can each have one or both wall surfaces formed with vertical corrugations 49. All of these corrugations can extend the full height of the panel devices.

The exemplary first panel device 30 and the second panel device 40 are formed as unitary, integral elements for the purpose of ease of manufacture and for cost reduction. In particular, these exemplary embodiments are molded from a strong, rigid thermoplastic material capable of withstanding pressure of concrete poured between the panel devices. Possible plastic materials include polypropylene and PVC but other known plastic materials can be used provided they have sufficient strength to enable the form module to withstand the lateral pressure rising from the weight of the liquid concrete when it is poured. Exemplary materials for these panel devices are reprocessed, recycled TCS PET 5VA5 natural and TCS PET mixed color. The first of these two is manufactured from recycled water bottles and can be used to form building exterior surfaces. The second of these can be used for the interior of a building. The illustrated external panel device 30 and internal panel device 40 each having a height greater than its respective thickness, which is possible due to the strength and rigidity of each of these panel devices.

An exemplary form of the panel device 40, which can also be described as a concrete block form panel structure, has an upper, elongate channel forming frame 50 rigidly connected to the outer surface of the outer wall portion 42. This frame 50 extends the length of the panel device 40 and includes an upper support plate 52 which is vertically disposed when the panel structure is in the upright position. The upper support plate extends the length of the frame 50, extends parallel to the outer surface 107 of the outer wall portion, and is spaced from this outer surface. The plate 52 is securely connected to the outer wall portion 42 by means of upper spacers 54. These upper spacers each comprise a horizontal portion 56 and at least one connecting panel 58. The spacers 54 at the opposite ends of the frame have only one panel 58 but the intermediate spacers have two panels 58. The two panels 58 for each intermediate spacer 54 are located at opposite ends of the portion 56. Rectangular holes 59 are formed between the portions 56. The horizontal portions 56 are level with the top edges of the outer wall portion 42 and the inner wall portion 44 (except for upwardly projecting tongues to be described).

The exemplary second panel device 40 is also provided with a lower, elongate channel forming frame 60 rigidly connected to the outer surface of the outer wall portion 42 and spaced from the upper frame 50 so that an elongate channel 61 for receiving equipment for one or more utilities is formed between the channel forming frames. The lower frame 60 extends substantially the length of the forming element or panel device 40 and includes a lower support plate 62, which is vertically disposed when the panel device 40 is in the upright position. The plate 62 is securely connected to the outer wall portion 42 by a plurality of lower spacers 64. The lower support plate 62 is substantially planar with the upper support plate 52 so that they form a substantially planar split surface that is adapted to mount wallboard or similarly interior building panels and the like for the finishing of an interior of a building. The support plates 52, 56 can be made of suitable thermoplastic material which enables them to receive and retain fasteners to mount the wallboard or other interior building panels. This plastic material can be the same as that used for the main body of the panel devices 30 and 40. An exemplary form of each lower spacer 64 comprises a horizontal portion 66 and a pair of connecting panels 68 securely connected to the ends of the horizontal portion 66. The portions 66 are level with the bottom edges of the outer wall portion 42 and the inner wall portion 44. Formed between the horizontal portions 66 are a series of spaced apart, rectangular holes 120.

Thus, in the exemplary internal panel device 40 shown, the upper spacers 54 and the lower spacers 64 together define vertical channels indicated generally at 122 capable of receiving equipment for utilities, such as electrical wiring, plumbing pipes and so on therein. It will be appreciated that these vertical channels together with the horizontal channels 61 formed between the upper and lower frames, when the form modules have been mounted on site and are in an in use form, define a utility matrix that permits electrical wiring, plumbing pipes and so on to be easily run anywhere along the structure created by the form modules 20 and the concrete.

Figure 6:
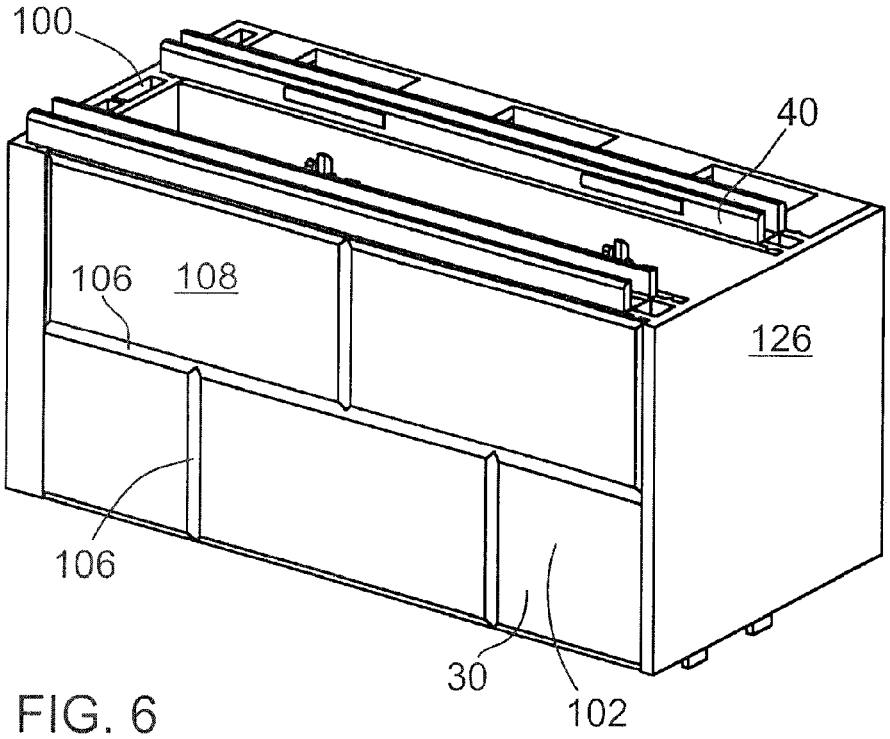
FIG. 6 is a perspective view of the forming module of FIG. 1 in the expanded or usable configuration and fitted with two end segments at opposite ends of the module.
Figure 7:
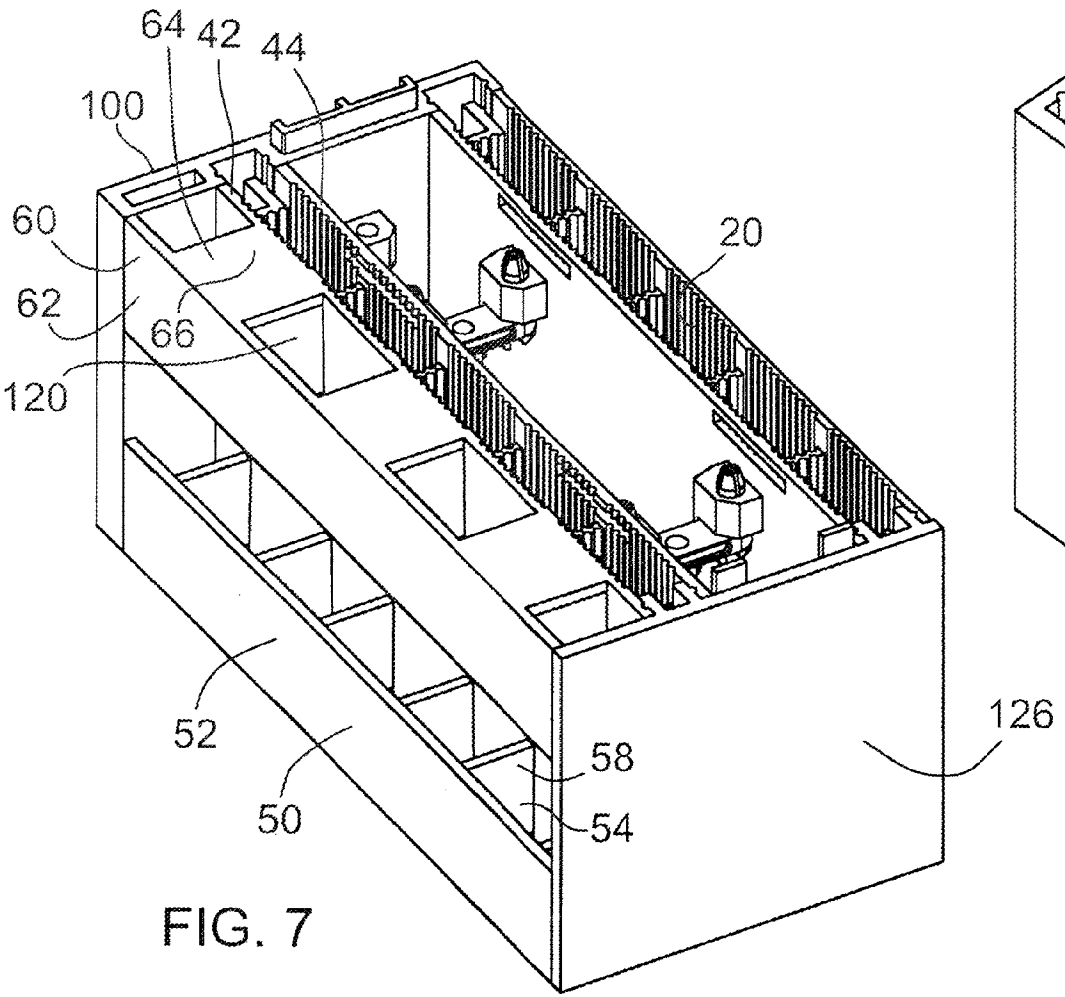
FIG. 7 is a perspective view showing the bottom of the module and the rear side thereof, the module being shown without reinforcing bars and being fitted with the two end segments.
Figure 10:
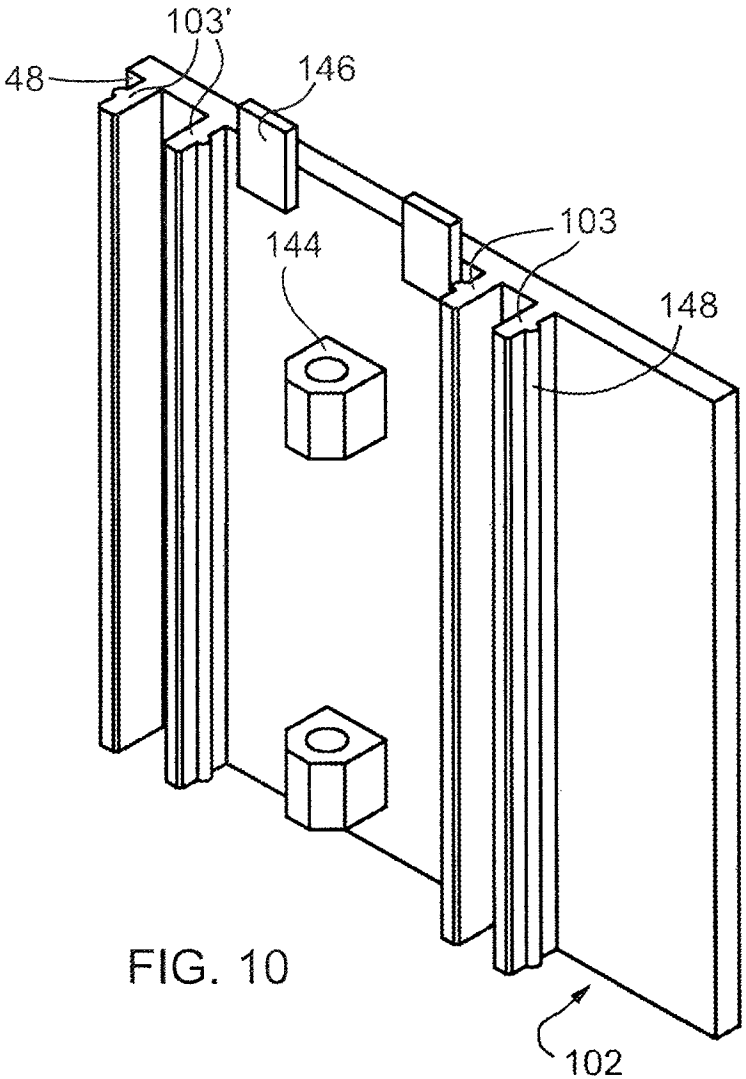
FIG. 10 is a perspective view of the other end segment used in the arrangement of FIG. 7, this view showing the inner side of the segment.

FIGS. 6 and 7 show one of the above described forming modules erected in a vertical position for use. In this position, it is ready for liquid concrete to be poured in the gap between the first and second panel devices. The illustrated form module 20 is used in combination with a so-called female end segment 100 shown separately in FIGS. 8 and 9, and a so-called male end segment 102, the inner side of which is shown in FIG. 10. These end segments are mounted vertically at opposite ends of the form module 20. Each has a flat, rectangular exterior surface indicated at 124 and 126. The female end segment is formed with a pair of vertical slots 201. These slots are separated by a rectangular, thick wall section 130 on which can be formed additional, projecting connectors 132 similar to the connectors 31. A connecting flange 134 forms one side of one slot 201 while a hollow wall section 136 can define one side of the other slot 201. End sections of the first and second panel devices 30, 40 fit into the slots 201 and the connectors 132, together with U-shaped couplers, can be used to hold the end segment 100 in its mounted position. In this way, the end segment 100 closes one end of the gap for concrete formed between the two panel devices. If desired, a connecting tab 138 can project from the top of the segment 100 in order to provide an alignment mechanism and a connection to an adjacent end segment (not shown).

In one embodiment of the form module 20, the second panel device 40 is formed with a first pair of substantially parallel, vertically extending tongues 85, which project beyond the upper and lower frames 50 and 60 (see FIG. 4) and it is these tongues which extend into the more central slot 201 of the end segment. Similarly, the first panel device 30 can be formed with a second pair of substantially parallel, vertically extending tongues 87 shown in FIG. 4. These extend into the slot 201 adjacent the flange 134. In one embodiment, each of the tongues 85 is formed with an elongate protrusion or ridge 85*a*, the end of one of these being visible in FIGS. 2 and 4. These protrusions or ridges then engage cooperating slots 142 formed in opposite sides of each slot 201. The engagement of the protrusions 85*a* in their respective slots 142 helps to hold the tongues 85 in their slots 201. Thus, a form of locking mechanism is provided for locking the female end segment in place. Similarly, a pair of elongate, vertically extending tongues 87 can be formed at the one end of the first panel device 30, and it is this pair of tongues which fits snugly into the slot 201 adjacent the flange 134. These tongues are also formed with protrusions or ridges 87*a* that engage in the slots 142 of the respective larger slot 201. In this way, the end of the panel device 30 is locked into the vertical slot 201.

Figure 8:
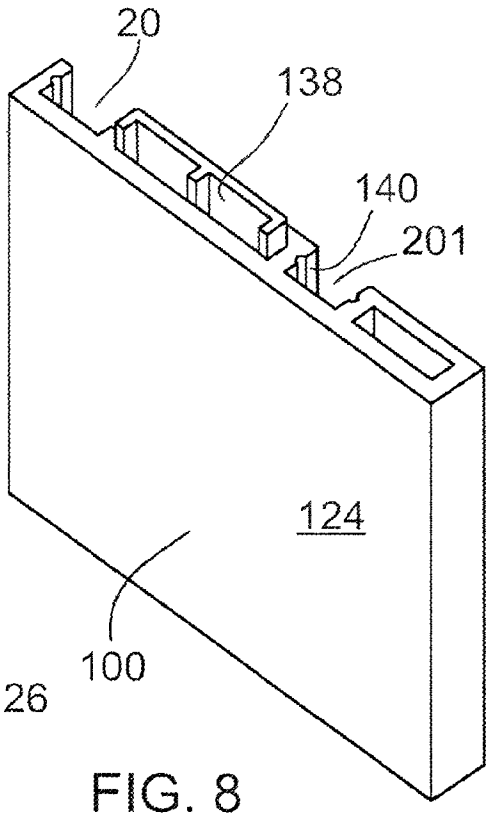
FIG. 8 is a perspective view showing the exterior surface of one of the end segments used in the arrangement of FIG. 7.

Turning now to the construction of the male end segment 102 shown separately in FIG. 10, this end segment has two pairs of vertically extending tongues indicated at 103 and 103'. The tongues extend the height of the end segment with the pair of tongues 103' being located near one vertical edge of the end segment and the other pair being located closer to the center. Located between the two pairs are projecting connectors 144, each of which can be provided with an aperture for receiving one pin of a suitable coupler such as the one shown in FIGS. 11 and 12. Thus, two couplers can be used to secure the male end segment to one end of the form module. There can be projecting from a top end of segment 102 a pair of alignment tabs 146 which help to align and join the end segment to an adjacent end segment. Each pair of the tongues 103, 103' fits snugly into a respective one of two vertical recesses 86, 88 formed in the panel devices. Each tongue can be formed with an elongate rib or ridge 148 on its exterior, and these can engage in cooperating slots 87*b* formed on opposite sides of each of the recesses 86, 88 shown in FIG. 4. The engagement between the ridges and the slots 87*b* acts as a lock to hold the end segment in place on the form module. It will be appreciated that the end segments shown in FIGS. 8-10 are optional components, which can be used to close off one or both ends of a form module constructed in accordance with the invention.

Figure 20:
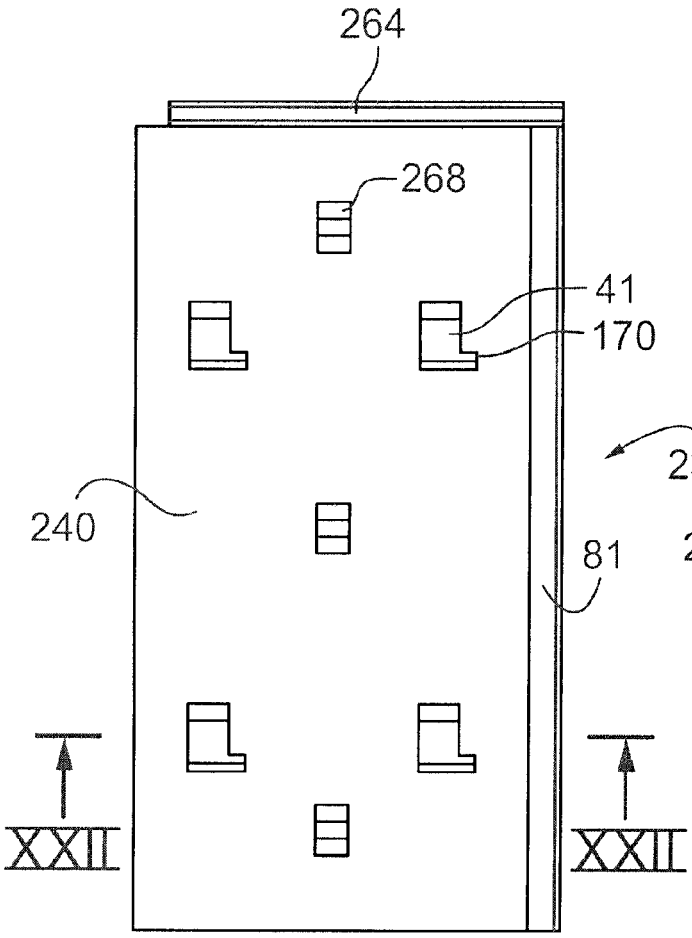
FIG. 20 is a side view of the panel device of FIG. 19.
Figure 21:
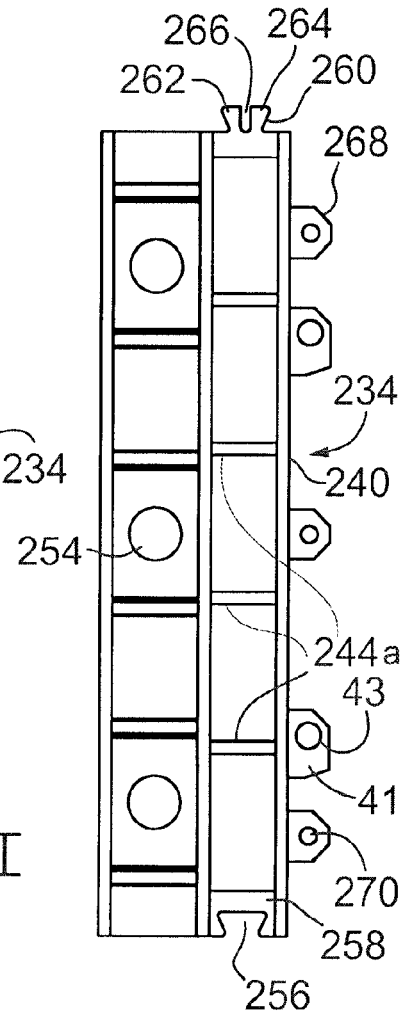
FIG. 21 is a longitudinal edge view of the panel device of FIG. 20.
Figure 22:
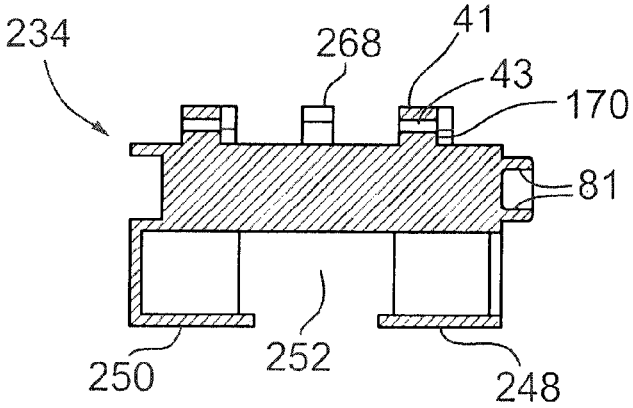
FIG. 22 is a cross-sectional view taken along the line XXII-XXII of FIG. 20.

As indicated, the exemplary forming modules 20 can be expanded manually from a collapsed shipping and storing configuration to a larger in-use configuration of maximum width. To enable this expansion, the connecting pins 76 of the couplers can pivot in their respective pin-receiving apertures of the connectors 31, 41. In the expanded state, the main body portion 74 of the coupler 72 can abut against a stopping surface formed by a protuberance 170 formed on the connector (see FIGS. 20 and 21). This engagement helps to retain the external and internal panel devices or forms in their fully expanded configuration.

In order to assemble the above described form modules and components to provide a formwork array for pouring concrete, the form block modules and components in their in-use configuration are arranged on site in horizontally extending rows and in end-to-end relation with the lowermost horizontal row placed on a suitable, standard foundation. Vertically and horizontally extending tongues are provided in order to properly align and hold together the form modules into the array. The horizontally extending tongues form part of a horizontally extending alignment mechanism while the vertically extending tongues form part of a further alignment mechanism extending along the vertical edges of each panel device. The horizontal alignment mechanism provides means for laterally aligning the form block modules and panel devices with other form modules and panel devices in the array disposed immediately above and below. In the exemplary form module, the horizontally extending alignment mechanism is provided both on the external panel device 30 and the internal panel device 40. In the exemplary illustrated embodiment, this alignment mechanism includes a first pair of substantially parallel horizontally extending tongues 81 projecting upwardly from the top of the internal panel device 40 and a second pair of substantially parallel, horizontally extending tongues 82 projecting upwardly from the top edge of the external panel device 30. The rib portions 46, which connect together these panel devices, terminate above the bottom edges of the inner and outer wall portions of each panel device, thereby providing longitudinal recesses 83 and 84, which are sized to receive the tongues. In particular, the tongues 81 are insertable in close fitting relation into the longitudinal recess 83 of another form module 20 located above the first form module. The tongues 82 are insertable in close fitting relation in the longitudinal recess 84 of the other form module. These pairs of tongues are able to hold the pressure from the concrete when it is poured. At the time of pouring, there is a pressure of 960 lbs per square inch on the form. The use of double tongues helps to avoid the use of bracing when the concrete is poured.

In an exemplary form of the tongues 81, they are each provided with at least one elongate protrusion on one side thereof for engaging a cooperating slot of the tongue receiving recess of the adjacent panel device during use of the form module in order to provide a mechanism for locking the two adjacent panel devices together. In the illustrated tongues, each tongue is provided with a pair of protrusions 81*a* that engage in cooperating slots 81*b* of the adjacent form panel. Alternately, it is possible to provide the protrusions 81*a* on only one of the two tongues. Similarly, each of the tongues 82 can be provided with a similar pair of elongate, horizontally extending protrusions that engage cooperating slots in one or both of the outer wall portion 32 and the inner wall portion 34 of the adjacent external panel device to provide a locking mechanism that locks together the vertically adjacent modules.

Figure 4:
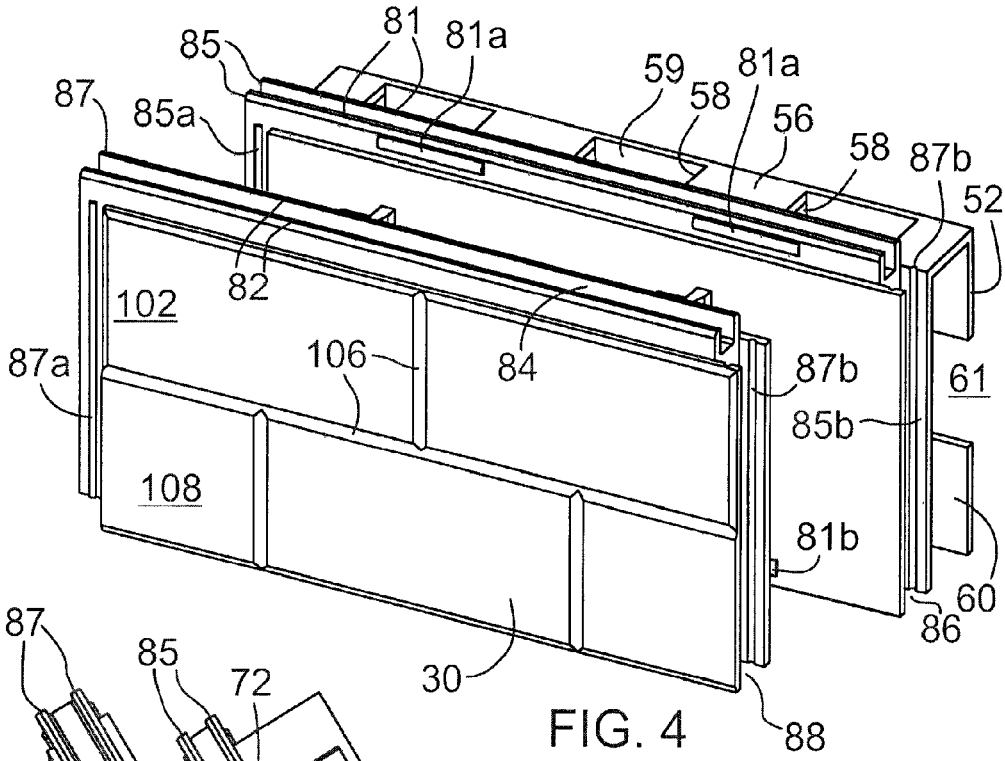
FIG. 4 is a perspective view of the embodiment of FIG. 3, this view showing a front side of the module which is visible after construction of a building with the module.

The alignment mechanism on the vertical edges of each panel device includes at least one vertically extending tongue projecting horizontally from one of the vertical edges of the panel device. In the version of FIGS. 3 and 4, there is the first pair of parallel, vertically extending tongues 85 extending horizontally from one end of the internal panel device 40 and the second pair of parallel, vertically extending tongues 87 extending horizontally from the corresponding end of the external panel device 30. The first pair of tongues are insertable in close fitting relation into a vertical recess 86 of the internal panel device 40 of an adjacent form module 20. The second pair of tongues 87 are insertable in close fitting relation into a vertical recess 88 of the external panel device 30 of the adjacent form module. In a particular form of these vertically extending tongues, they are provided with one or more protrusions in order to provide a locking mechanism. As illustrated, the tongues 85 are provided with respective elongate protrusions or ridges 85*a* which engage cooperating slots 85*b* formed in both the outer wall portion and the inner wall portion of the panel device 40 of a horizontally adjacent form module 20. Similarly, each of the tongues 87 of the external panel device 30 can be provided with an elongate protrusion or ridge 87*a* that engages an elongate cooperating slot 87*b*. The slots 87*b* are formed in each of the outer wall portion 32 and the inner wall portion 34 of the horizontally adjacent external panel device.

Once the form modules have been put in place and connected as described, concrete is poured into the space or hollow interior 90 of the formwork array to form a finished wall structure when the concrete is set and cured. It will be appreciated that a method of forming a building or other walled structure has also been described herein. This method includes the provision of a plurality of the described form block modules 20 and arranging them in an array placed on a suitable foundation in interconnected relation as described above. The structure forming method is then completed by pouring liquid concrete into the formwork formed by the block modules to form a finished structure when the concrete is set.

FIGS. 11 and 12 illustrate an exemplary form of one of the couplers 72. The exemplary connecting pins 76 each have a transverse slot 180 that extends diametrically across the full width of the pin and that extends longitudinally a substantial portion of the length of the pin from tapered end 182. The slot 180 divides at least an end section of the pin into end portions 184, 186 that can be compressed inwardly towards one another. At least one pin of each coupler 72 and preferably both pins are formed with a split end part indicated at 190 having a larger maximum diameter than the remainder of the pin or pins and its respective pin-receiving aperture. In other words, one or both pins has an enlarged end part, which can be described as a radially outwardly flared end part that is provided to hold the pin or pins in place. It is possible to insert the split end part 190 into its aperture by the aforementioned inward compression of the two end portions. Once the end part 190 has passed completely through the aperture, it will expand to hold the coupler in place.

Exemplary versions of the coupler 72 can also be used to hold metal reinforcing rod 29 in place in the formwork. As shown in FIGS. 11 and 12, the main body of the coupler can be provided with a vertically oriented hole or aperture 71. This hole can be centrally located, that is midway between the two axes of the pins. In addition, there can be optionally provided a pair of slots 73 extending transversely across the main body portion 74. Each of the hole and slots is adapted to receive one of the reinforcing bars during the use of the module so that the coupler can provide support for the rod. In a normal orientation of the coupler where the pins extend vertically, the bar extending through the hole is vertical and the bars supported in the slots extend horizontally. The reinforcing bars or rods of course provide added strength to the finished structure after the poured concrete has set.

Figure 13:
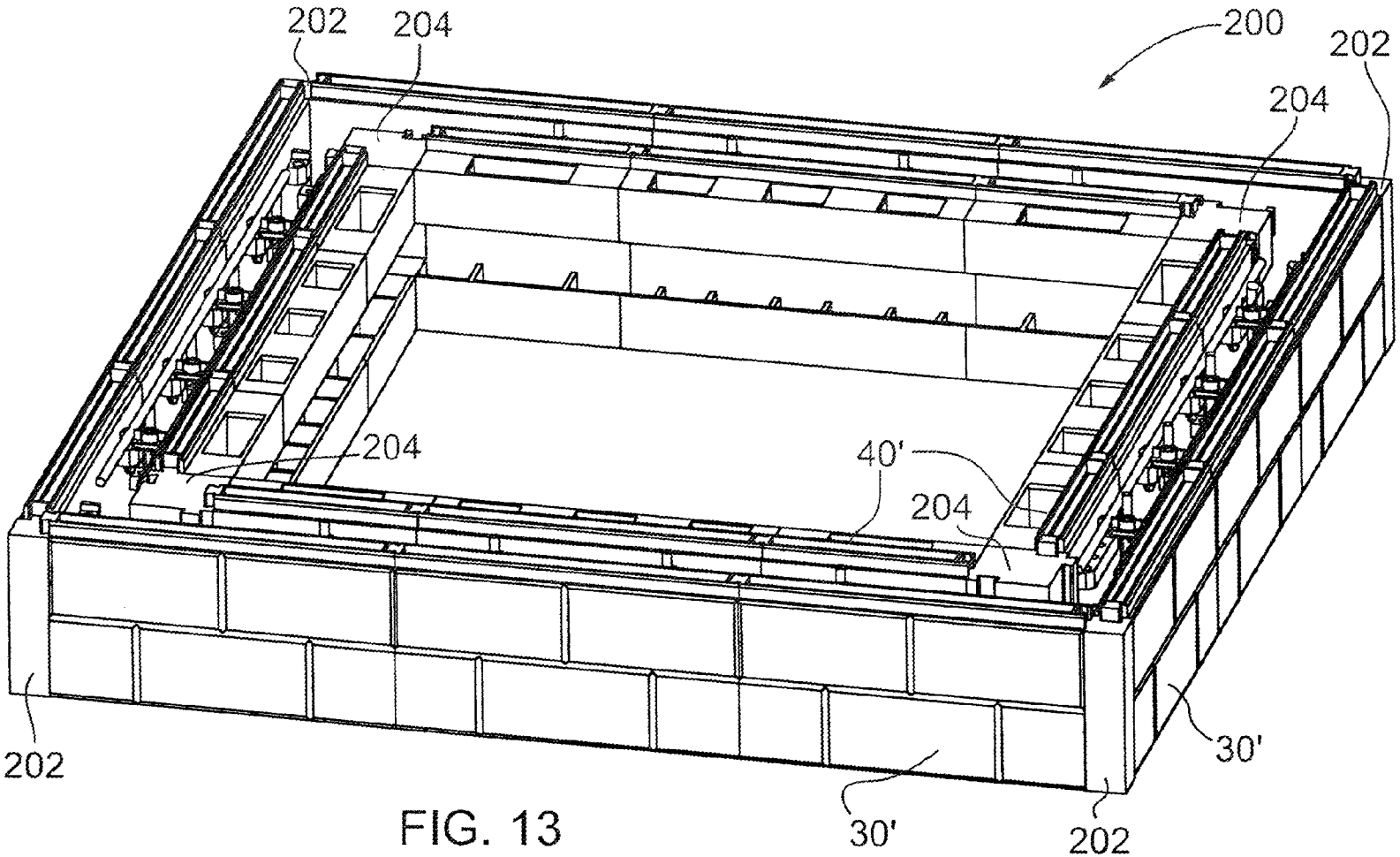
FIG. 13 is a perspective view taken from above illustrating both the interior and exterior of a rectangular structure that can be built using the concrete form modules and interior and exterior corner connectors.
Figure 14:
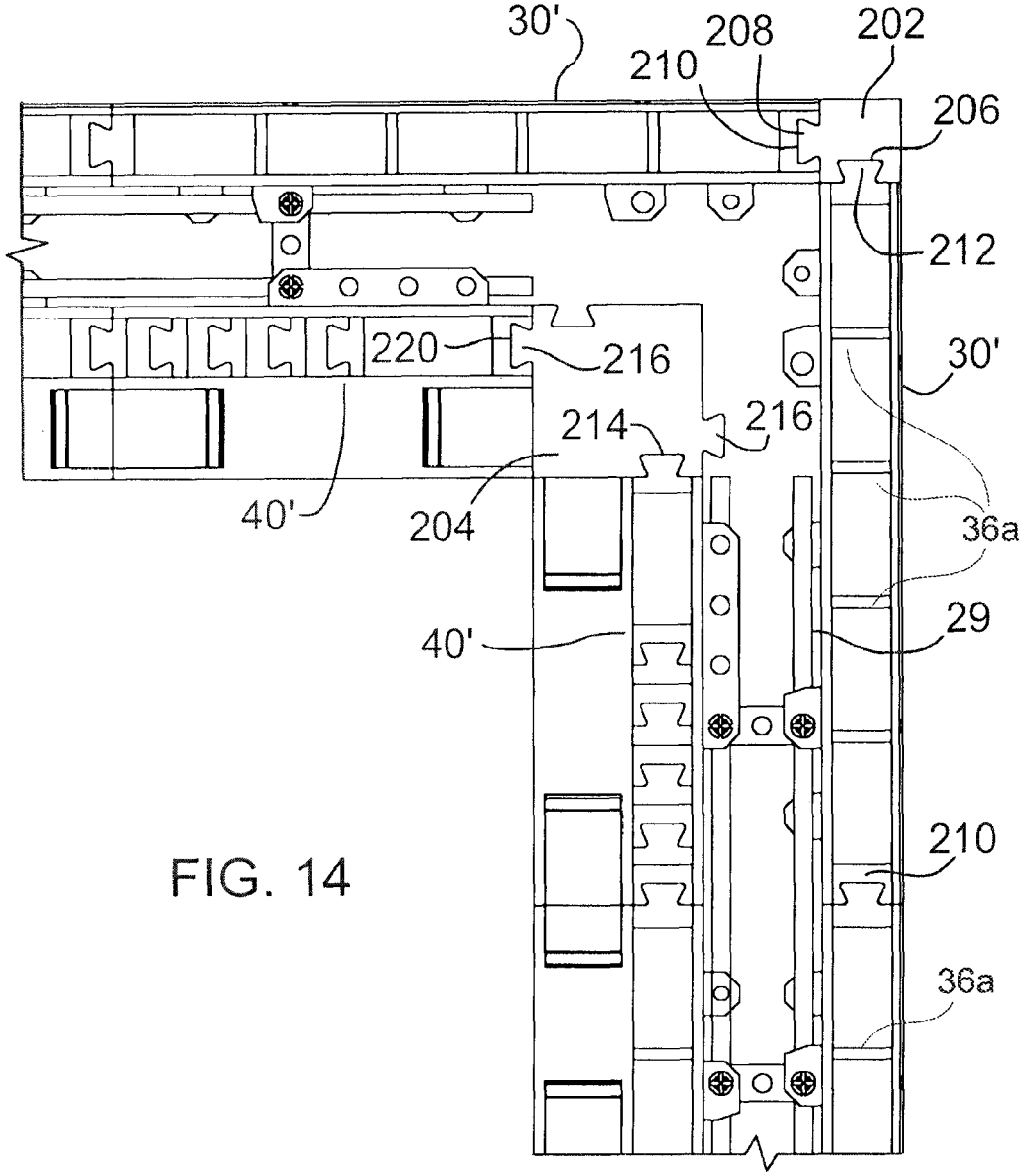
FIG. 14 is a cut-away plan view of a corner section of the structure of FIG. 13 illustrating how the form modules can be connected at a 90 degree corner.

FIG. 13 illustrates a rectangular building structure 200 prior to the pouring of the concrete between the internal and external panel devices. FIG. 14 shows further details of one corner of this structure. In particular these two figures show the use of vertically extending corner connectors to connect together the form modules at the four corners. In particular there are shown four external corner connectors 202 and four internal corner connectors 204. Each external corner connector can be used to connect together two panel devices 30 at a 90 degree angle, while each internal corner connector can be used to connect together two internal panel devices 40 at a 90 degree angle. The external connector 202 can be provided with a vertically extending dovetail groove 206 on one side and a dovetail shaped tongue connector 208 on another side. For this corner connector to be used, one end of the external panel device 30' has a dovetail groove 210 that extends vertically. The other end of the panel device 30' is provided with a dovetail shaped tongue connector 212 that extends vertically when the form module is in the upright position. It will be understood that the groove 210 and the tongue connector 212 replace the tongues 87 and the recess 88 of the panel device 30 of FIGS. 1 to 4.

The internal corner connector 204 is formed with two longitudinally extending dovetail grooves 214 located on opposite sides of the connector. Alternatively it is possible to provide only one dovetail groove 214 on one side of the connector. Also formed on this connector are two dovetail shaped tongue connectors 216 located on opposite sides of the connector. For connection to the connector 204, the internal panel device 40' is formed with a dovetail shaped tongue connector 218 at one end that extends vertically and at the opposite end this panel device has a dovetail groove 220. The tongue connector 216 fits snugly into the groove 220 while the tongue connector 218 fits snugly into the groove 214 of the connector.

Figure 15:
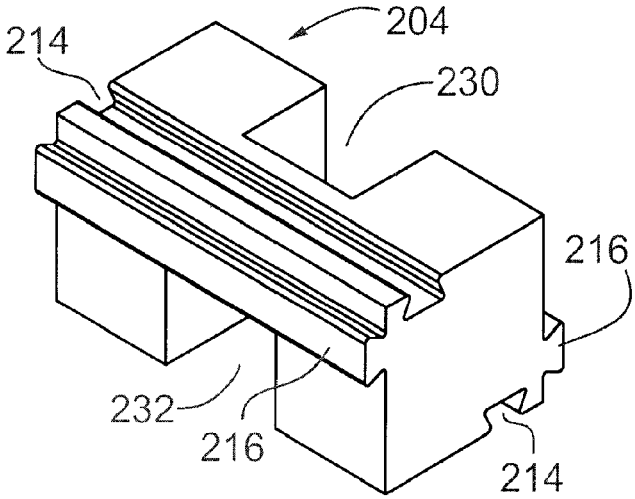
FIG. 15 is a perspective view showing two sides and one end of an interior corner connector used in the structure of FIG. 13.
Figure 16:
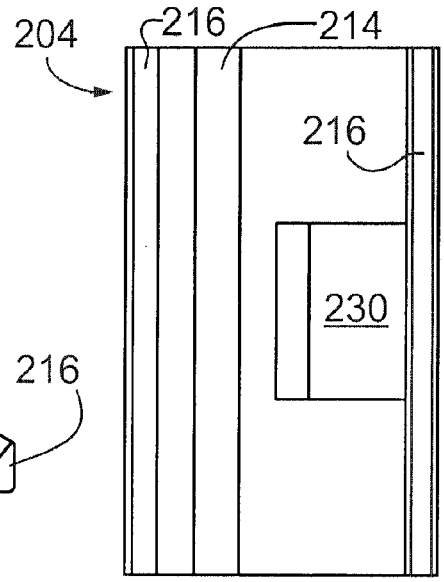
FIG. 16 is a vertical side view of the connector of FIG. 15.
Figure 18:
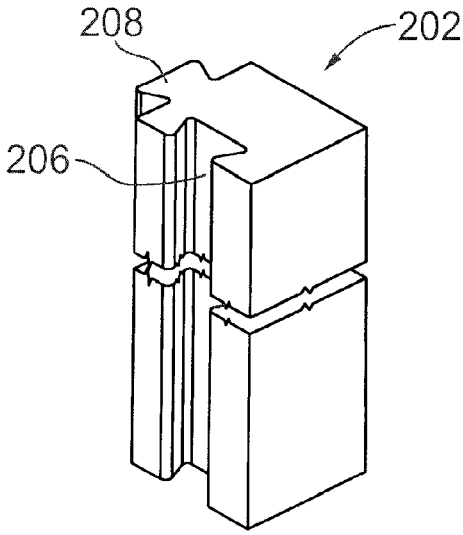
FIG. 18 is a perspective view showing two vertical sides and one end of the exterior corner connector used in the structure of FIG. 13.
Figure 17:
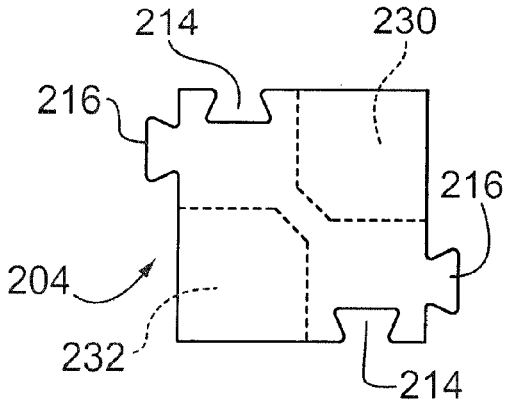
FIG. 17 is an end view of the connector of FIG. 15.

The internal corner connector 204 is shown separately in FIGS. 15-17. In the illustrated exemplary embodiment, the connector is formed with two substantial cut-outs 230 and 232 located on opposite corners of the connector and located centrally along the length of the connector. These cut-outs can have a substantially square shape as shown. It will be appreciated that these cut-outs allow for passage of utilities around the corner of the formwork formed by the form modules. In other words, the cut-out located on the interior corner of the attached concrete form panel structures allows for an open connection between the elongate, horizontal channels formed between the channel forming frames of the adjacent panel structures.

Figure 19:
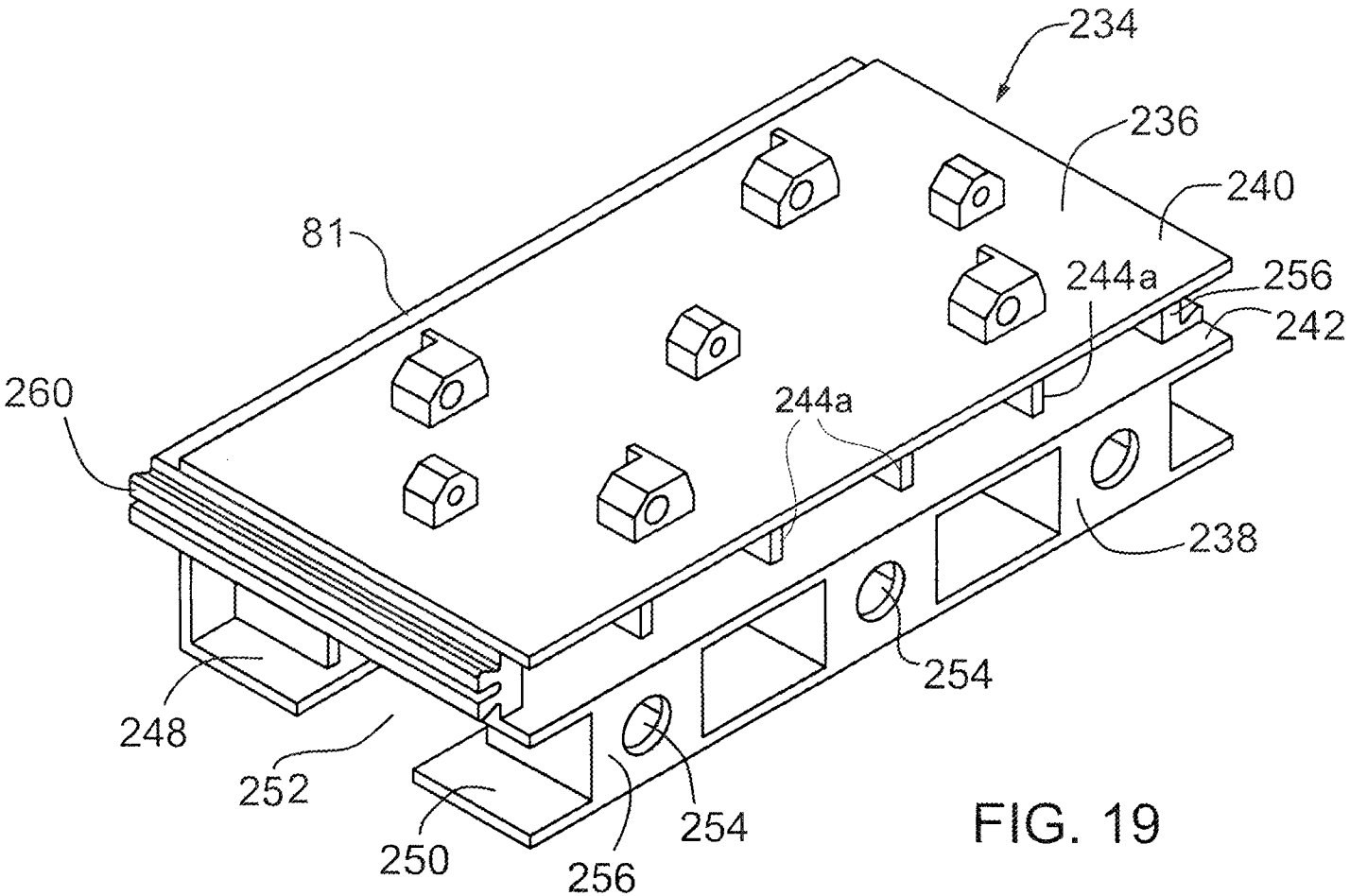
FIG. 19 is a perspective view of another embodiment of an internal concrete forming panel device, this view showing one end and an outwardly facing surface.

FIG. 19 illustrates an alternate embodiment of an internal concrete forming block panel device identified by reference 234. It will be understood that this panel device can be used as part of a concrete form block module similar to the modular 20 shown in FIGS. 1 and 2. The panel device 234 has inner and outer faces 236 and 238. Except for the differences noted hereinafter, the panel device 234 is similar in its construction to the second panel device 40 shown in FIGS. 1 and 2. It will be noted that the panel device 234 is not formed with vertical corrugations on the interior surfaces or on the connecting ribs. The primary difference between the panel device 234 and the second panel device 40 is the form of the panel connectors extending along the vertical edges of the panel devices. The panel device 234 has a substantially planar outer wall portion 240 and a substantially planar inner wall portion 242. These wall portions are rigidly connected by means of parallel rib portions 244*a* and, preferably, horizontal rib portion 244*b*. The panel device 234 also has an upper channel forming frame 248 extending the length of the panel device and a lower, elongate channel forming frame 250. These two frames can be constructed in a similar manner. An elongate channel 252 for receiving equipment for one or more utilities is formed between the frames 248, 250. The only difference between the frames 248, 250 and the corresponding frames in the embodiment of FIGS. 1 and 2 is the provision of circular holes 254, which are optional and which are provided to facilitate the molding of the panel device. The holes 254 are formed in horizontal portions 256 of the frame 250 and, as can be seen from FIG. 21, similar circular holes are formed in the upper channel forming frame 248.

Turning now to the connectors extending along the opposite vertical edges of the panel device, extending along one vertical edge is a dovetail shaped channel 256. This channel is formed in panel edge wall 258, extending between wall portions 240 and 242. Extending along the opposite vertical edge of the panel device is an elongate dovetail connector 260, which has an external dovetail shape as shown. In the exemplary embodiment, this connector is formed by two tongues 262, 264, which are separated by a gap 266. Because the two tongues are constructed of plastic having some flexibility, this connector construction facilitates the insertion of the connector 260 in the channel 256 of a horizontally adjacent panel device. It will be understood that the external dimensions of the connector 260 corresponds substantially to the dimensions of the channel 256 and thus when two of the panel devices 234 are connected using their respective connector 260 and channel 256, the connection is strong and able to withstand the pressure created by liquid concrete. In one particular embodiment of the panel device, the height of the tongues 262, 264 is 0.75" and the depth of the channel 256 is 0.77".

As in the embodiment of FIGS. 1 and 2, the panel device 234 is provided with connectors 41, each with a pin-receiving aperture 43. These connectors are integrally formed on the panel device 234. Optionally, there can be provided additional connectors 268, each with a pin-receiving hole 270. The connectors 268 can be aligned with each other and extend along the longitudinal centre line of the panel device. These connectors can provide additional means for joining the panel device 234 to a similar rigid external concrete forming block element 272 shown in FIG. 23. The connectors 268 are particularly useful for forming a thick wall of concrete in the range of 8 to 12 inches thick when the pressure exerted by pouring concrete is higher. These connectors help to keep a straight line in the array with the form block modules and also help the plastic panel devices to stay connected to the concrete after hardening and not become separated over time. Separation of the outer panel device from the concrete wall with the passage of time is undesirable (particularly in cold climates) because it could cause water to come between the panel device and the concrete wall.

Figure 23:
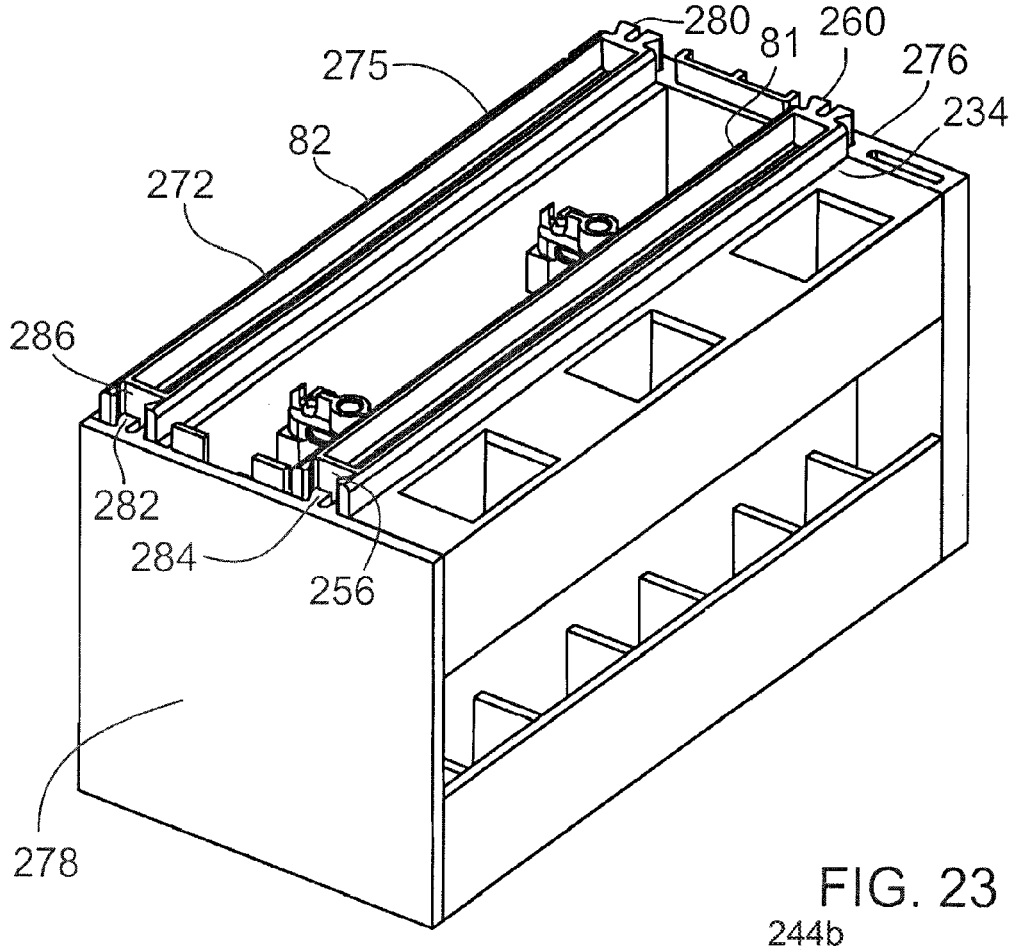
FIG. 23 is a perspective view of another embodiment of forming module in an expanded configuration and filled with another version of two end segments at opposite ends of the module.

FIG. 23 shows an alternate form of forming module 275 that incorporates the internal panel device 234. Except for the differences noted hereinafter, the forming module of FIG. 23 is similar in its construction to the forming module shown in FIGS. 6 and 7. The module 275 is used in combination with a female end segment 276 and a male end segment 278. These end segments are mounted vertically at opposite ends of the module 275. The female end segment 276 is similar to that illustrated in FIGS. 8 and 9 except that its vertically extending slots are dovetailed shaped slots that can snugly receive the dovetail connectors 260 and 280.

Turning now to the construction of the male end segment 278, this end segment has two pairs of vertically extending tongues indicated at 282 and 284. It will be understood that each of these pairs forms a dovetail connector for the end segment. The tongues are separated by a gap so that they can be pressed inwardly in order to facilitate insertion of these connectors into dovetail grooves or channels 256 and 286. Except for the difference in the connectors, the male end segment 278 is similar in its construction to the male end segment 102 of FIG. 10.

Figure 24:
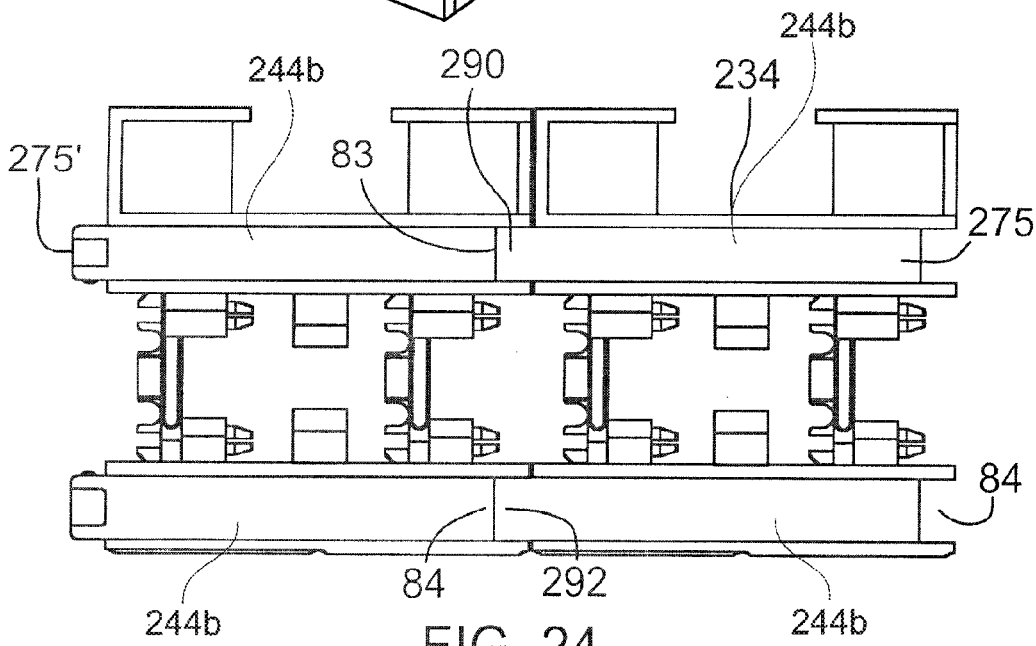
FIG. 24 is an edge view of two forming modules in an expanded condition and connected together along adjacent longitudinal edges.

FIG. 24 illustrates two of the forming modules 275, 275' connected together along adjacent longitudinal edges and shown horizontally (for illustration purposes). The tongues 81 that project from the upper edge of the internal panel device 234 together form a projecting connector 290 with the tongues being connected together at their opposite ends. The connector extends into an elongate recess 83 formed in the bottom of the panel device 275'. Similarly, the pair of tongues 82 formed on the external forming element 272 together provide a projecting connector 292. Again, the tongues 82 are connected to one another at their ends as illustrated in FIG. 23. The connector 292 extends into the longitudinal recess 84.

Figure 25:
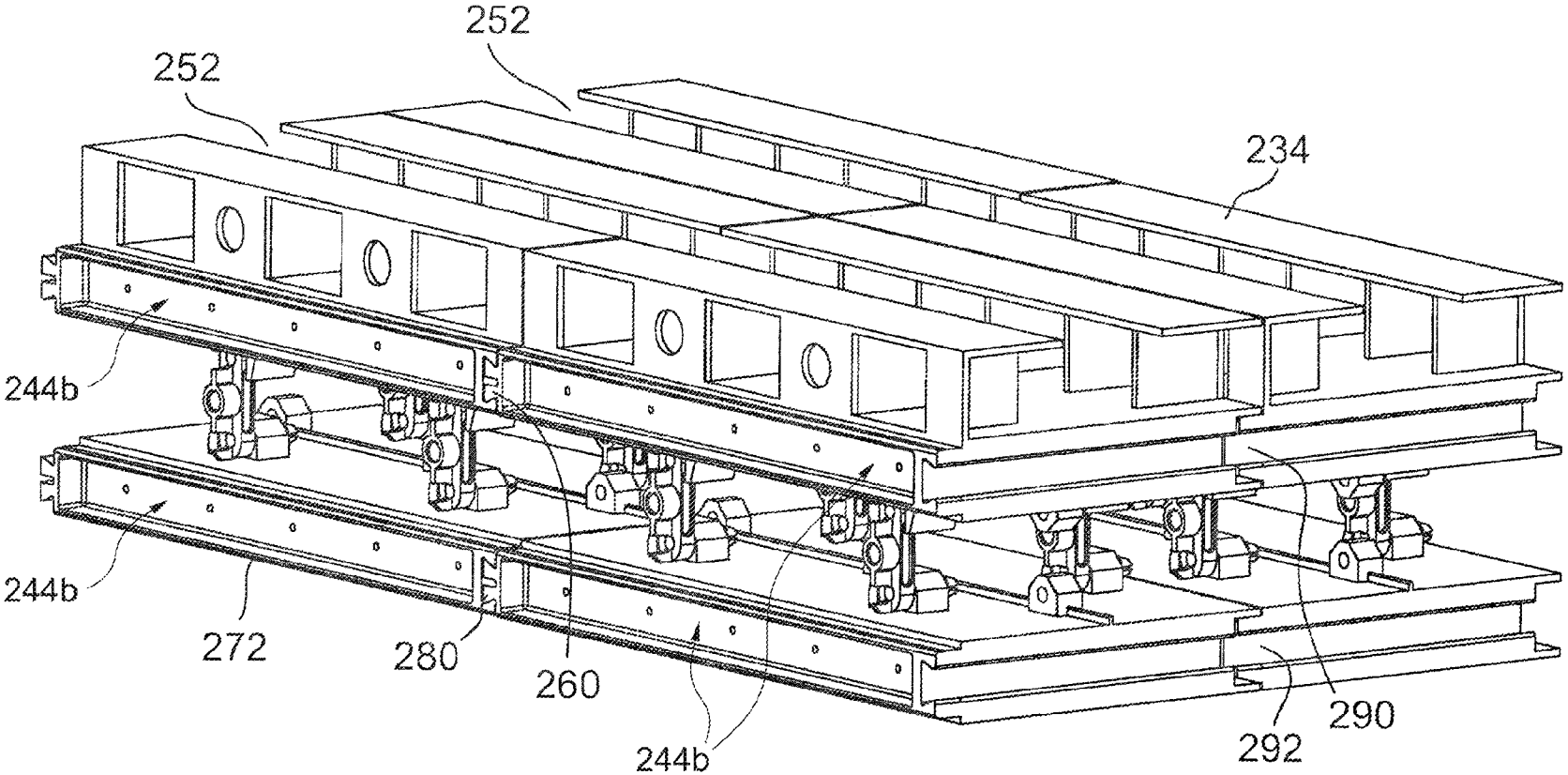
FIG. 25 is a perspective view showing the interior side of four forming modules in an expanded condition and connected together to provide a concrete framework.

FIG. 25 illustrates how four of the internal panel devices 234 can be connected to one another, along with their corresponding external concrete panel devices or elements 272. The panel devices are shown spaced apart so that they are ready for use. The internal panel devices in the horizontal direction are connected together by their dovetail connectors 260, while the exterior panel devices or form elements 272 are connected together in the horizontal direction by their respective dovetail connectors 280. The adjacent longitudinal edges of the panel devices are connected together by projecting connectors 290 and 292. It will be seen that in the formwork array of blocks of FIG. 25, there are two of the channels 252 which extend parallel to one another, each capable of providing passage for utilities.

Variations of the above described form modules and form panel structures and components will be apparent to those skilled in the manufacturing and construction of concrete forms and concrete forming panels and such variations are considered to be within the scope of the present invention. Thus modifications and alterations can be used in the construction and manufacture of the form modules and form panels of the present invention without departing from the scope of the invention.

We claim:

1. A concrete forming block for construction of a building wall or foundation structure by assembly of a plurality of said blocks into a horizontally and vertically extending array of blocks adapted to hold and form the concrete and to remain in place after pouring of the concrete as part of the building or other walled structure, said block comprising:

(a) a first and a second thin-walled molded panel each of said panels including integral spaced apart inner and outer walls extending across the width and height of said block, (b) a plurality of ribs within each said panel integrally molded between and rigidly connecting and separating respective spaced apart inner and outer walls to form hollow spaces between the said respective inner and outer walls adapted to receive thermal insulating material, (c) said panels being disposed for use vertically in generally parallel relationship such that said inner walls are substantially opposite one another for facing poured concrete and forming same; and (d) a plurality of connectors between said first and second panels each integrally molded into and projecting from a respective said inner wall, wherein said panels are suitable for pouring concrete substantially vertically therebetween in order to form a structural body of concrete when the concrete has hardened.

2. The concrete forming block as claimed in claim 1 wherein said plurality of ribs within each of said panels includes a plurality of generally vertically oriented ribs extending substantially across the height of the said panel.

3. The concrete forming block as claimed in claim 2 wherein said plurality of ribs within each of said panels includes at least one horizontally oriented rib extending along the width of the said panel.

4. The concrete forming block as claimed in claim 3 wherein said horizontally oriented rib extends across the full width of said panel.

5. The concrete forming block as claimed in claim 4 wherein said plurality of vertically oriented ribs within each said panel includes a rib along each extremity of said block.

6. The concrete forming block as claimed in claim 4 wherein said horizontally oriented rib is adjacent a horizontal extremity of said block and is adapted to form unitary vertically oriented hollow space pockets between said walls in conjunction with said walls and said plurality of vertically oriented ribs.

7. The concrete forming block as claimed in claim 6 wherein said block further comprises corresponding pairs of interconnections at opposite extremities of said block separate from said ribs, each pair of interconnections is adapted to interconnect with adjacent blocks in an array and to align said panels with one or more other panels arranged adjacent to said block in a wall or foundation form structure.

8. The concrete forming block as claimed in claim 7 wherein said pairs of interconnections include an opposing dovetail interconnection and an opposing tongue and groove interconnection.

9. The concrete forming block as claimed in claim 8 wherein said dovetail interconnections are vertically oriented.

10. The concrete forming block as claimed in claim 9 wherein said hollow space pockets are exposed along said tongue and groove interconnections.

11. The concrete forming block as claimed in claim 10 wherein said interconnections are continuous along a corresponding block extremity.

12. The concrete forming block as claimed in claim 11 wherein said hollow space pockets are filled with thermal insulation.

13. The concrete forming block as claimed in claim 1 wherein said panels are adapted to be moved from a collapsed empty configuration with reduced space between said inner walls and a concrete-forming array configuration with substantially more space between said inner walls by means of said connectors.

14. The concrete forming block as claimed in claim 13 wherein said first and second panels are each integrally molded as a unitary panel device of strong, rigid thermoplastic material capable of withstanding pressure of concrete poured between said panels in an array.

15. The concrete forming block as claimed in claim 14 further comprising:

(a) an upper elongate channel forming frame rigidly molded into said outer wall including an upper support plate which:

A. extends lengthwise of the upper channel forming frame, and,

B. extends parallel to and spaced from said outer wall; and (b) a lower elongate channel forming frame rigidly molded into said outer wall and spaced from said upper frame including a lower support plate which:

A. extends lengthwise of the lower channel forming frame,

B. extends parallel to and spaced from said outer wall, (c) so that an elongate channel for receiving utilities equipment is formed between said channel forming frames, and, (d) wherein said upper and lower support plates are coplanar and adapted to mount wallboard or similar interior building panels.

16. The concrete form panel structure according to claim 15 wherein:

(a) at least one of said upper and lower channel forming frames include spacer members each extending between said outer wall and one of the upper or lower support plates, and, (b) said spacer members define vertical channels capable of receiving equipment for utilities.

* * * * *